United States Patent [19]

Braun et al.

[11] Patent Number: 4,554,063

[45] Date of Patent: Nov. 19, 1985

[54] CATHODIC, GAS- AND LIQUID-PERMEABLE CURRENT COLLECTOR

[75] Inventors: Moritz Braun, Zollikerberg; Anna Kaufmann, Bülach; Edwin Müller, Zürich, all of Switzerland

[73] Assignee: BBC Brown, Boveri & Company Limited, Baden, Switzerland

[21] Appl. No.: 606,477

[22] Filed: May 3, 1984

[30] Foreign Application Priority Data

May 6, 1983 [CH] Switzerland ..... 2482/83

[51] Int. Cl.[4] ..... C25B 9/00

[52] U.S. Cl. ..... 204/254; 204/268; 204/294

[58] Field of Search ..... 204/294, 254, 255, 268

[56] References Cited

U.S. PATENT DOCUMENTS

| | | | |
|---|---|---|---|
| 4,118,294 | 10/1978 | Pellegri | 204/294 |
| 4,294,893 | 10/1981 | Iemmi | 204/294 |
| 4,312,736 | 1/1982 | Menth | 204/294 |
| 4,339,322 | 7/1982 | Balko | 204/268 |

*Primary Examiner*—John F. Niebling

*Attorney, Agent, or Firm*—Oblon, Fisher, Spivak, McClelland & Maier

[57] ABSTRACT

Especially for bipolar membrane electrolysis cells, cathodic current collectors (8) are required which have a high electrical conductivity, a large contact surface area and a sufficient porosity to ensure the passage of reaction educts and products, for example, water and gas. At the same time, they should be chemically, mechanically and thermally stable. No protective voltage should be required while the cells are closed down. The current collector consists of graphite powder (12) of high purity, having particle sizes in the range from 10 μm–200 μm, and carbon fibres (13) which are irregularly distributed therein and have lengths from 1 mm to 30 mm, the graphite powder/carbon fibre mass ratio being in the range from 10:1 to 30:1. The binder used is polyvinylidene fluoride. For producing the current collector, the binder is dissolved in, for example, dimethylformamide. Graphite powder and carbon fibres are then added and the resulting lubricating grease-like mass is brought to the desired thickness by spreading on a glass plate and is dried for about 1 hour at about 50° C. The current collector can be used especially for water electrolysis, chlor-alkali electrolysis and hydrochloric acid electrolysis.

21 Claims, 3 Drawing Figures

CATHODIC, GAS- AND LIQUID-PERMEABLE CURRENT COLLECTOR

Figure 1:
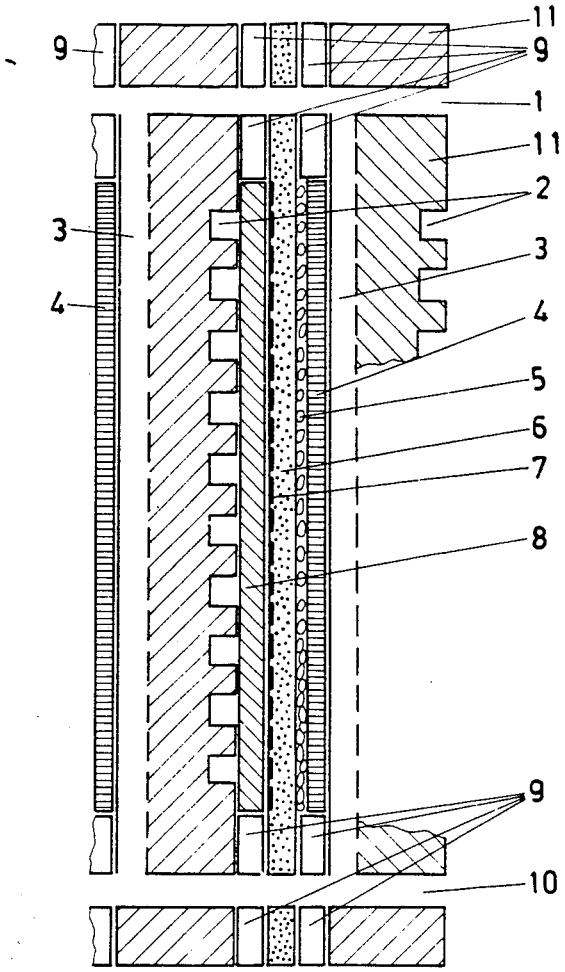

This invention relates to a cathodic gas- and liquid-permeable current collector comprising (1) a pulverulent carrier material consisting of graphite powder and carbon fibres and (2) a binder for the carrier material. The invention also relates to a process for producing and methods for using such cathodic current collectors.

Cathodic current collectors have been described in German Offenlegungsschrift No. 2,610,253. In this publication, a porous electrode is disclosed which is used in fuel cells and which has an electrically conductive grid used as the collector and a porous, electrically conductive layer on or in which very thin fibres of an electrically conductive material are present. These fibres are intended to reduce the internal resistance of the electrode. The carrier material used for this porous layer is, in particular carbon to which a binder of a polymeric material, such as polyethylene, polytetrafluoroethylene or polyvinyl chloride may be added. The fibres consist preferably of a metal of high specific conductivity; they can also consist of carbon. Their thickness is in the range from 150 μm–350 μm. The length/thickness ratio of the fibres is at least 100:1. A pulverulent carrier material and/or a catalytically active material and/or a binder and/or a pore former are pressed at elevated temperature to give an electrode, after which the pore former can be leached out. Finally, the electrically conductive grid is partially pressed into the layer complex obtained.

In particular for bipolar plate cell units with several individual cells in series, it is desirable to have dimensionally stable and compressible cathodic current collectors available which are free of metallic conductors and therefore do not require a protective voltage when they are not in operation, i.e., when the electrolysis unit is closed down.

Membrane electrolysis cells are distinguished by employing an ionically conductive plastic membrane as the electrolyte, in place of a liquid electrolyte. Such cells are preferably used in cases where the anolyte and catholyte spaces must be separated from one another, because otherwise, for example, educts and/or products would react with one another in an undesired manner, as, for example, in water electrolysis, or where only certain ions can be allowed to pass from one into the other half-cell space, as, for example, in chloralkali electrolysis.

Because of their compact construction, however, membrane cells also have other advantages.

In such commercially important processes as chloralkali electrolysis and water electrolysis, only cation exchanger membranes, that is to say acid membranes, can be used for reasons of process engineering and/or stability. A perfluorinated plastic, such as, for example a cation exchanger based on perfluorinated polytetrafluoroethylene (PTFE), which is commercially available, for example, under the trade name "Nafion" from Du Pont de Nemours, is used in most cases as the carrier of the functional groups.

For reasons of activity and stability, virtually only noble metals can be used as the electrode materials for acid membranes. In water electrolysis, platinum is used preferably on the cathode side, and mixed noble metal oxides are used on the anode side. For reasons of economy, these noble metal electrode layers must be applied to the membranes in the thinnest possible form. In practice, coating densities of only 1 g to a few g of noble metals per $m^2$ of area are used. For this reason, such layers are discontinuous at some points and have only very low transverse conductivities (that is to say conductivity in the membrane plane). To ensure an economical current density, it is therefore necessary in the optimum case to contact each electrode grain electrically in such a way that the current passes with the smallest possible loss from a current distribution system to the electrode grain. At the same time, the electrode grain can be supplied with reaction educts and freed from products in the best manner possible.

A component which fulfils these functions is called a current collector. It must have the following properties:

- the highest possible electrical conductivity,
- a large contact surface,
- a low contact resistance to the electrode material,
- chemical, mechanical and thermal stability,
- sufficient porosity to ensure mass transfer to and from the electrode,
- ease of manufacture and assembly of the cells, and
- low costs.

This invention achieves the object of providing a cathodic current collector which can be manufactured easily and at favourable costs, can be operated without a protective voltage and ensures good contact pressure.

One advantage of the invention is that electrolytic cells with the current collector according to the invention do not require a protective voltage when closed down. The metal-free current collector cannot suffer chemical corrosion. The graphite powder ensures good conductivity; at the mass ratio indicated, the carbon fibres guarantee the good mechanical properties of the current collector. At the same time, good compressibility of the current collector is ensured, so that certain irregularities in the thickness distribution of this and other cell components can be compensated and low contact resistances are ensured.

In the production of the current collector, very little binder is required, since the latter is distributed very uniformly and in a suitable form within the composite body being produced. The solvent expelled on heating can be recovered and re-used.

Regarding the relevant state of the art, additional reference is made to German Offenlegungsschrift No. 3,028,970 which, for halogen electrolysis, discloses the use of fine wire netting or metal wire fabric as the cathode current collectors, which are pressed against a diaphragm or a membrane.

German Offenlegungsschrift No. 2,905,168 discloses the use of sintered bodies of graphite and tetrafluoroethylene, reinforced with metal wire fabric, as the cathode current collectors in water electrolysis.

Although the metal wire fabrics, used almost exclusively, exert a sufficient supporting pressure on the membranes, they can only make pointwise contact and therefore always involve the risk of so-called "hot spot formation", that is to say overloading of the membrane in terms of current at this point, and in the worst case this can lead to the membrane burning through and to a short circuit. Moreover, the metal wires used are not sufficiently stable chemically over the entire range of potentials which occur in the cell. For example when closed down, the cells must then be provided with a protective voltage, and this makes the unit more complicated.

Figure 2:
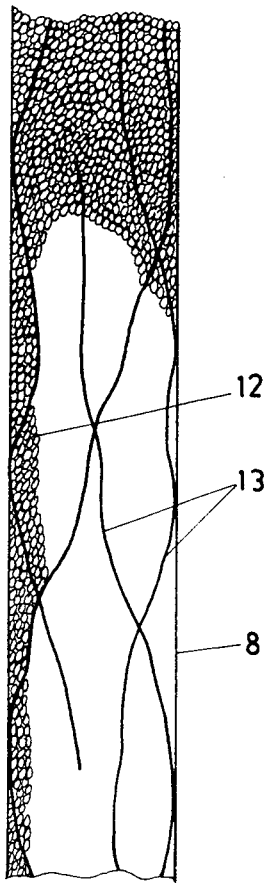
Figure 3:
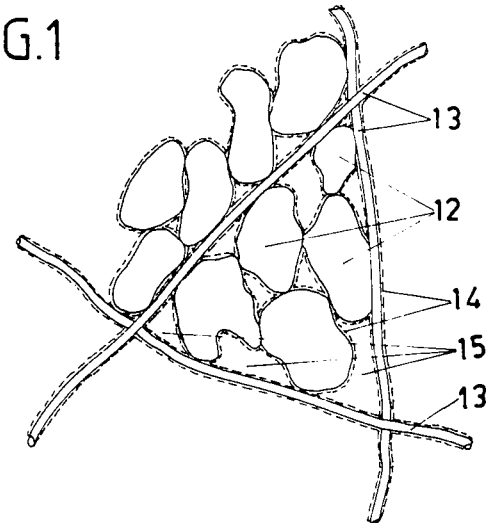

The invention is explained below by reference to an illustrative embodiment. In the drawing:

FIG. 1 shows part of a cross-section of an electrolytic cell with a cathode current collector according to the invention, FIG. 2 shows part of a cross-section through a cathode current collector, and FIG. 3 shows an enlarged part of a cathode current collector.

FIG. 1 shows a part of a water electrolysis cell block with several bipolar plate cell units connected in series. In place of a liquid electrolyte, an ion exchanger membrane 6 of perfluorinated plastic is provided. It serves at the same time as the partition between the anolyte and catholyte. This ion exchanger membrane is coated on both sides with catalytically active metals, that is to say with an anode electro-catalyst 5 on the anode side and with a cathode electro-catalyst 7 on the cathode side. A process for coating is described in European Published Application No. 0,048,505.

The ion exchange membrane 6 is in contact with the anode side of a bipolar plate 11 of corrosion-resistant material via an anode-side current collector 4 consisting of a porous titanium plate, and it is in contact with the cathode side of another bipolar plate 11 of the same construction via a cathode-side current collector 8 according to the invention. The bipolar plate 11 has cathode-side distributing grooves 2 and, arranged perpendicular thereto, anode-side distributing grooves 3. The anode-side distributing grooves 3 are connected to a water feed channel 10 and to a collecting channel 1 for discharging oxygen and water. Electrolytically produced hydrogen is discharged through the cathode-side distributing grooves 2. Seals 9 serve to insulate and seal the ion exchange membrane 6 from the two adjoining bipolar plates 11.

The educt used is highly pure water, in order to avoid contamination of the porous current collectors which are permeable to water and gas and have a high electrical conductivity.

The cathode-side current collector 8 consists of an approximately 1 mm thick, plane-parallel flat plate of graphite grains 12 and carbon fibres 13, which are both coated by a binder 14, compare FIGS. 2 and 3. Between the graphite grains and carbon fibres, there are pores 15. The thickness of the plate is in the range from 0.5 mm to 3 mm, preferably in the range from 0.8 mm to 1.5 mm.

The graphite powder used in graphite of a purity of at least 99.9% and of a particle size of 10 μm–200 μm, preferably of 30 μm–100 μm. The carbon fibres used are so-called staple fibres, that is to say loosely cut fibres of 1 mm–30 mm, preferably 3 mm–10 mm, length. They are distributed irregularly between the graphite grains and serve to increase the mechanical strength and dimensional stability of the current collector plate. The binders used are soluble fluorocarbon polymers, such as, for example, polyvinylidene fluoride (PVDF), and dimethylformamide ($DMF=HCON(CH_3)_2$) and other alkylated acid amides are preferably used as the solvent for the binder. Acetone ($CH_3COCH_3$) and other ketones can also be used.

The compressibility of the current collector can be adjusted during the removal of the solvent via the residual content of the latter. The expelled solvent can be recovered and re-used.

The plates can be formed by casting, spreading, extrusion or any other distributing method which leads to an adequate thickness distribution. Preferably, a suspension of lubricating grease-like consistency is prepared and processed.

A graphite powder/carbon fibre mass ratio in the range from 10:1 to 30:1, preferably in the range from 15:1 to 20:1, is selected and 4% to 20%, preferably 5% to 10%, of binder are used, relative to the total mass of carbon. The porosity of the current collectors thus produced is adjusted such that it is in the range of 40% to 70%, preferably in the range from 50% to 60%.

ILLUSTRATIVE EXAMPLE 1

7 g of PVDF obtainable, for example, under the trade name "Vidar" from the German company SKW Trostberg is dissolved cold in 90 g of DMF, with stirring. 87 g of graphite powder obtainable, for example, under the name "KS 75" from the Swiss company Lonza, and 5 g of carbon fibres obtainable, for example, under the name "Grade VMA" from the U.S. company Union Carbide, are added to this solution with continuous slow-stirring. This gives a lubricating grease-like mass which is spread on a highly polished plate, for example a glass plate, and is scraped with a scraping strip or a doctor blade to give a 1 mm thick layer. Larger quantities are preferably extruded. The glass plate with the mass is dried for about one hour on a hot plate in the range from 20° C.–70° C., preferably at about 50° C., that is to say until the desired residual DMF content has been reached, whereupon the finished current collector can be detached from the glass plate by means of water.

Current collectors produced in this way did not show any degradation phenomena over 1,000 hours in an experimental water electrolysis cell at 1.5 $A/cm^2$ current density and at 130° C. The cell voltages obtainable in this cell were 1.8 V.

ILLUSTRATIVE EXAMPLE 2

52.2 kg of KS 75 graphite powder from Lonza were stirred, together with 3.0 kg of Thornel VMA carbon fibres from Union Carbide, into a solution of 3.3 kg of Vidar PVDF from Trostberg in 41.5 kg of DMF, and the resulting mass was extruded by means of a single-screw extruder of 45 mm diameter and a screw length of 1,350 mm through a slot die of 1.1 mm slot width. The extrudate was degassed by means of vacuum in the extruder. The screw speed was 40 revolutions per minute, and the pressure at the extruder head was 5 bar.

The extrudate was collected on glass plates of $700\times700\times3$ $mm^3$ size, the plates on a transport belt being drawn through at 4 mm/second under the nozzle.

The coated glass plates were dried for 2 hours at 40° C. in a circulating-air oven, and the finished current collectors were detached from the glass plates in a water basin. In this way, it was possible to produce plates of 0.8 mm thickness with a tolerance of ±0.03 mm.

When used in water electrolysis cells, current collectors produced in this way showed the same behaviour as those described in Illustrative Example 1. Due to their somewhat lower PVDF content, however, they can be compressed a little more readily in the cells, namely by about 10% under 4.5 bar contact pressure. In this way, irregularities of up to 0.08 mm can be compensated.

The required thickness tolerances (about ±30 μm) for the current collector plates can more easily be maintained with the production process according to the invention than with a sintering process and/or pressing process.

In addition to the water electrolysis, the current collectors according to the invention are also suitable for the chlorine electrolysis, the hydrochloric acid electrolysis and quite generally for membrane electrolysis processes.

What is claimed as new and desired to be secured by Letters Patent of the United States is:

1. A cathodic gas and liquid-permeable current collector comprising:

a pulverulent carrier material comprising graphite powder and carbon fibers wherein the mass ratio of graphite powder:carbon fibers is between 10:1 and 30:1, and a binder, wherein the mass fraction of the binder relative to the total mass of the current collector is between 4 and 20% the collector having a porosity of 40 to 70%.

2. The cathodic current collector of claim 1, wherein the graphite powder:carbon fibre mass ratio is in the range from 15:1 to 20:1 and the mass fraction of the binder relative to the total mass of the current collector is between 5% and 10%.

3. The cathodic current collector of claim 1, wherein the porosity of said current collector is between 50 and 60%.

4. The cathodic current collector of claim 3 wherein the particle size of said graphite powder is in the range from 10 μm–200 μmand the length of the carbon fibres is in the range from 1 mm–30 mm.

5. The cathodic current collector of claim 4, wherein the partible size of said graphite powder is in the range from 30 μm–100 μm and the length of said carbon fibres is in the range from 3 mm–10 mm.

6. The cathodic current collector of claim 1, wherein said binder is a fluorocarbon polymer.

7. The cathodic current collector of claim 6, wherein said fluorocarbon polymer is polyvinylidene fluoride.

8. A cathodic gas-and liquid-permeable current collector consisting of:

a flat glass plate;

pulverulent carrier material comprising graphite powder and carbon fibers wherein the mass ratio of graphite powder:carbon fibres is between 10:1 and 30:1; and a binder, wherein the mass fraction of the binder relative to the total mass of the current collector is between 4 and 20%;

wherein the thickness of the collector is between 0.5 and 3 mm the collector having a porosity of 40–70%.

9. The collector of claim 8, wherein the thickness of the collector is between 0.8 and 1.5 mm.

10. The cathodic current collector of claim 9, wherein the graphite powder:carbon fibre mass ratio is in the range from 15:1 to 20:1 and the mass fraction of the binder relative to the total mass of the current collector is between 5% and 10%.

11. The cathodic current collector of claim 8, wherein the porosity of said current collector is between 50% and 60%.

12. The cathodic current collector of claim 9, wherein the particle size of said graphite powder is in the range from 10 μm–200 μm and the length of the carbon fibres is in the range from 1 mm–30 mm.

13. The cathodic current collector of claim 12, wherein the particle size of said graphite powder is in the range from 30 μm–100 μm and the length of said carbon fibres is in the range from 3 mm–10 mm.

14. The cathodic current collector of claim 9, wherein said binder is a fluorocarbon polymer.

15. The cathodic current collector of claim 14, wherein said fluorocarbon polymer is selected from the group consisting of polyvinylidene fluoride.

16. A bipolar membrane electrolytic cell comprising an anode, a cathode and an ion exchange membrane of perfluorinated plastic which is coated on both the anode and cathode sides with catalytic active metals; wherein said ion exchange membrane is in contact on the anode side with a bipolar plate, containing a corrosion-resistant material via a porous titanium current collector plate and wherein the cathode side of said ion exchange membrane is in contact with a bipolar plate via a current collector having a porosity of 40–70% comprising:

a pulverulent carrier material comprising graphite powder and carbon fibers wherein the mass ratio of graphite powder:carbon fibers is between 10:1 and 30:1 and a binder, wherein the mass fraction of the binder relative to the total mass of the current collector is between 4 and 20%.

17. The electrolytic cell of claim 16, wherein the graphite powder:carbon fibre mass ratio is in the range from 15:1 to 20:1 and the mass fraction of the binder relative to the total mass of the current collector is between 5% and 10%.

18. The electrolytic cell of claim 16, wherein the particle size of said graphite powder is in the range from 10 μm–200 μm and the length of the carbon fibres is in the range from 1 mm–30 mm.

19. The electrolytic cell of claim 18, wherein the particle size of said graphite powder is in the range from 30 μm–100 μm and the length of said carbon fibres is in the range from 3 mm–10 mm.

20. The electrolytic cell of claim 16, wherein said binder is a fluorocarbon polymer.

21. The electrolytic cell of claim 20, wherein said fluorocarbon polymer is polyvinylidene fluoride.

* * * * *